United States Patent [19]

Steinhardt et al.

[11] Patent Number: 5,046,201

[45] Date of Patent: Sep. 10, 1991

[54] PRESSURIZED FLUSH TOILET TANK

[75] Inventors: Michael D. Steinhardt, Kiel; Mark A. Risberg; John M. Bloemer, both of Sheboygan, all of Wis.

[73] Assignee: Kohler Co., Kohler, Wis.

[21] Appl. No.: 510,304

[22] Filed: Apr. 16, 1990

[51] Int. Cl.[5] ..... E03D 3/10

[52] U.S. Cl. ..... 4/354

[58] Field of Search ..... 4/354–362

[56] References Cited

U.S. PATENT DOCUMENTS

| | | | |
|---|---|---|---|
| Re. 16,785 | 11/1927 | Keating . | |
| Re. 26,235 | 7/1967 | Woodford | 137/218 |
| 566,770 | 9/1896 | Kenney . | |
| 566,771 | 9/1896 | Kenney . | |
| 995,930 | 6/1911 | Walker . | |
| 999,829 | 8/1911 | McNutt . | |
| 1,083,974 | 1/1914 | Wulf . | |
| 1,116,901 | 11/1914 | Loetzer | 4/362 |
| 1,229,505 | 6/1917 | Osmer . | |
| 1,231,828 | 7/1917 | West et al. . | |
| 1,245,738 | 11/1917 | Koenig . | |
| 1,248,777 | 12/1917 | Ahlheim . | |
| 1,346,362 | 7/1920 | Wulf . | |
| 1,443,690 | 1/1923 | Keating . | |
| 1,654,870 | 1/1928 | Fremion . | |
| 1,774,690 | 9/1930 | Willoughby . | |
| 2,049,382 | 7/1936 | Deming | 50/23 |
| 2,156,823 | 5/1939 | Stettner | 50/23 |
| 2,170,321 | 4/1939 | Charroin | 4/26 |
| 2,447,067 | 6/1944 | Hamilton | 50/23 |
| 2,502,262 | 3/1950 | Labiche | 4/26 |
| 2,595,012 | 4/1952 | Smith | 251/27 |
| 2,608,210 | 8/1948 | St. Clair | 137/541 |
| 2,816,812 | 12/1952 | Peck | 21/2.5 |
| 2,904,305 | 9/1959 | Novotny | 251/175 |
| 2,938,464 | 5/1960 | Nielsen | 103/6 |
| 3,011,176 | 2/1961 | Langdon | 4/27 |
| 3,029,443 | 4/1962 | Naccarato | 4/26 |
| 3,114,532 | 12/1963 | Gray et al. | 251/30 |
| 3,225,696 | 12/1965 | Brigman | 103/6 |
| 3,376,013 | 4/1968 | Mallett | 251/38 |
| 3,397,408 | 8/1968 | Skousgaard | 4/26 |

(List continued on next page.)

OTHER PUBLICATIONS

Applicant's Exhibit No. 18, Catalog of Watts Regulator Co., 815 Chestnut Street North, Andover, Massachusetts, pp. 14–16, admitted prior art.

Applicant's Exhibit No. 19, eleven pages of prior art, updated building code requirements relating to back siphonage protection.

Applicant's Exhibit No. 23, brochure entitled "Circle Seal Controls Relief Valves 500 Series Popoff, Inline 5–150 PSI" of Circle Seal Controls, Brunswick Corporation, P.O. Box 3666, Anaheim, California, 92803, admitted prior art.

Applicant's Exhibit No. 33, "Circle Seal Controls PVR Series Corrosion Resistant Regulators Pressure Range Inlet-3000 PSI Outlet-60 PSI" ad of Circle Seal Controls, Brunswick Corporation, P.O. Box 3666, Anaheim, California, 92803, admitted prior art.

*Primary Examiner*—Charles E. Phillips
*Attorney, Agent, or Firm*—Quarles & Brady

[57] ABSTRACT

A toilet has a pressurized reservoir tank which is connected to a source of water via a backflow preventer, a pressure regulator and an aspirator. The inlet to the tank extends from the upper portion of the tank down into the lower portion to discharge water in the lower portion until a preset pressure in the tank is reached. A flush valve body provides a seal between a captured seal ring and a valve housing and a secondary seal between the bottom of the valve body and an annular surface of the valve housing, which also serves as a downward stop. In an alternate embodiment, a breather hole is provided in the upper portion of the inlet tube to allow for draining of the reservoir tank.

3 Claims, 4 Drawing Sheets

U.S. PATENT DOCUMENTS

| | | | |
|---|---|---|---|
| 3,547,400 | 12/1970 | Burtness | 251/88 |
| 3,553,741 | 1/1971 | Owens | 4/67 |
| 3,555,571 | 1/1971 | Gibbs et al. | 4/31 |
| 3,579,648 | 5/1971 | Owens | 4/52 |
| 3,581,313 | 6/1971 | Haglund et al. | 4/26 |
| 3,605,125 | 9/1971 | Gibbs et al. | 4/26 |
| 3,628,195 | 12/1971 | Skousgaard | 4/26 |
| 3,636,968 | 1/1972 | Tine | 137/102 |
| 3,677,294 | 7/1972 | Gibbs et al. | 137/572 |
| 3,747,621 | 7/1973 | Tine | 137/218 |
| 3,789,432 | 2/1974 | Pozzi | 4/26 |
| 3,817,279 | 6/1974 | Larson | 137/572 |
| 3,817,286 | 6/1974 | Caron et al. | 137/628 |
| 3,817,489 | 6/1974 | Caron et al. | 251/38 |
| 3,820,171 | 6/1974 | Larson | 4/31 |
| 3,820,754 | 6/1974 | Larson | 251/38 |
| 3,890,651 | 6/1975 | Wood | 4/26 |
| 3,905,382 | 9/1975 | Waterston | 137/102 |
| 4,013,088 | 3/1977 | Gocke et al. | 137/116 |
| 4,060,857 | 12/1977 | Couton | 4/26 |
| 4,115,883 | 9/1978 | Dauvergne | 4/353 |
| 4,142,262 | 3/1979 | Hamilton | 4/354 |
| 4,143,433 | 3/1979 | Skousgaard | 4/354 |
| 4,154,426 | 5/1979 | Santy et al. | 251/175 |
| 4,183,108 | 1/1980 | Hamilton | 4/354 |
| 4,232,409 | 11/1980 | Van Pham | 4/362 |
| 4,233,698 | 11/1980 | Martin | 4/354 |
| 4,304,015 | 12/1981 | Hubatka | 4/407 |
| 4,407,025 | 10/1983 | Hennessy et al. | 4/321 |
| 4,707,868 | 11/1987 | Hennessy | 4/362 |

FIG. 9
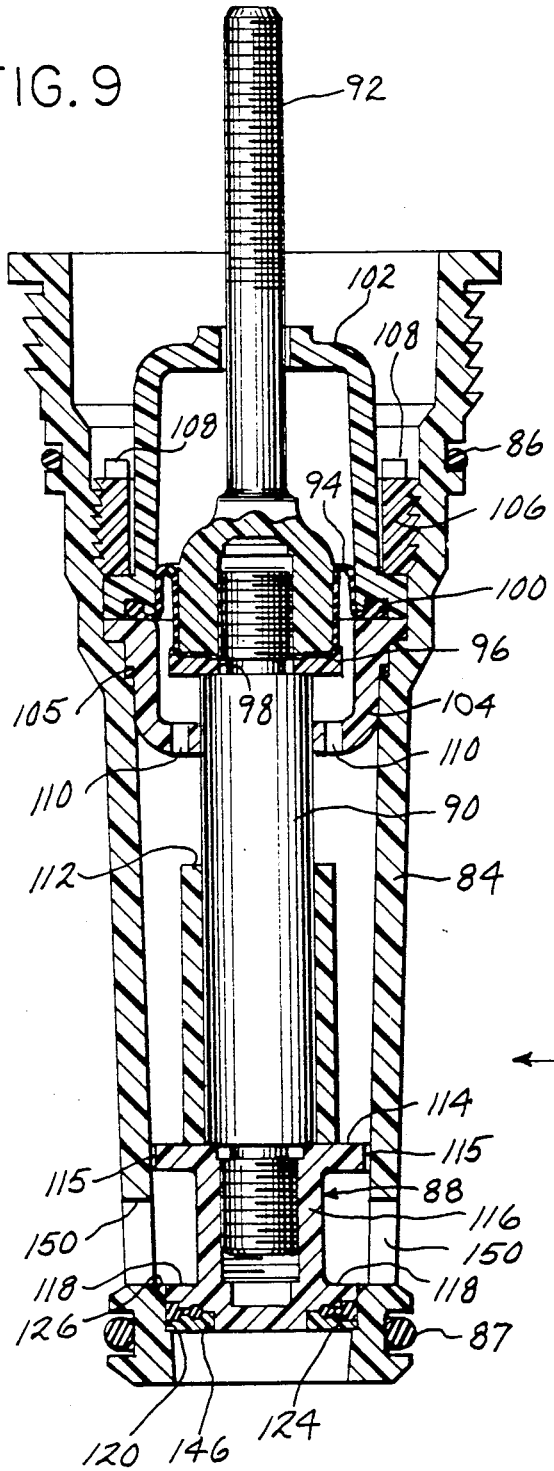
FIG. 11
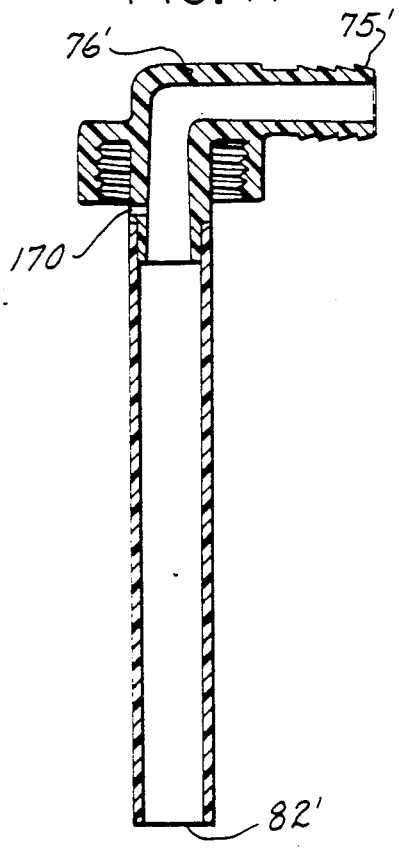
FIG. 12
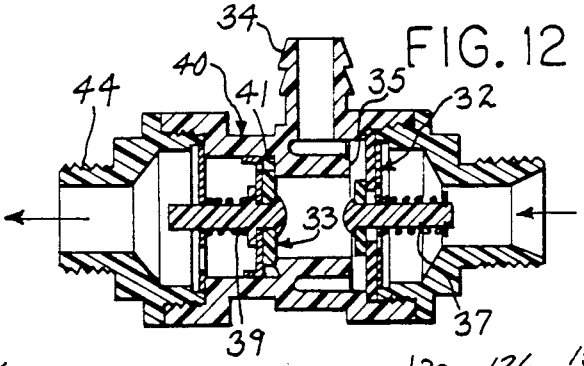
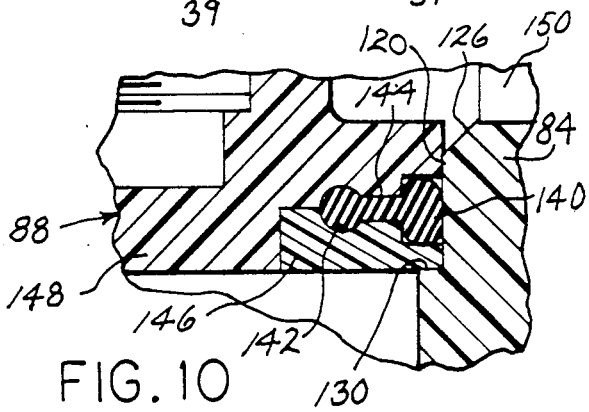
FIG. 10

PRESSURIZED FLUSH TOILET TANK

BACKGROUND OF THE INVENTION

The invention relates to pressurized flush toilets.

DISCUSSION OF THE PRIOR ART

Gravity feed toilets of the type having a reservoir above the level of a toilet bowl can be found in practically every home in the U.S. The reservoir typically holds 3 to 5 gallons of water in anticipation of flushing the toilet bowl contents. A flush is achieved by breaking a seal at the bottom of the reservoir, which allows the flush water to flow by gravity into the toilet bowl. Since the flow depends upon gravity, these types of toilets cannot be made below a certain height.

Gravity feed toilets also use relatively large amounts of water, which is in short supply in some areas and correspondingly expensive to treat. Because of this, toilets using less than 3 to 5 gallons of water per flush have been proposed and implemented.

One way to improve the flush with a smaller amount of water is to have a pressurized flush system. These toilets typically have a pressurized reservoir to hold the flush water and a valve which is actuatable by the user to discharge the reservoir contents into the toilet bowl. See, e.g., U.S. Pat. No. 3,605,125. Such valves are expected to reliably seal against leakage when the reservoir is pressurized, to be easily actuated by the user, and to be durable over a long period of time with little or no maintenance.

One problem in some valves of this type has been that the pressure required to seat the valve and the force required to actuate the valve has been too high or difficult to control over time. Another problem is that the force with which water is expelled from the reservoir can blow off the seal of certain valve elements. Thus, a need exists for an improved pressurized toilet flush valve.

Moreover, pressurized flush toilet systems have sometimes been difficult to drain and recharge. When the inlet water is turned off, draining the tank can create a vacuum in the reservoir which inhibits proper draining. Moreover, if the tank became waterlogged so as to become completely filled with water without an air space, it was difficult to flush or otherwise drain the tank contents.

SUMMARY OF THE INVENTION

The present invention provides a pressurized flush tank for delivering water to a toilet having a reservoir tank for containing a pressurized volume of flush water. The reservoir tank has an inlet for connection to a source of pressurized water and an outlet for communication to a toilet bowl. A valve housing inside the reservoir tank provides a seal against the outlet of the reservoir tank and has an interior cavity, an exterior wall and an inlet which provides communication between the interior cavity and the tank through the exterior wall. A valve seat inside the housing is located between the housing inlet and the reservoir tank outlet. The valve seat has an annular surface with a radially outward circumferential edge and a radially inward circumferential edge. The radially outward circumferential edge intersects an axially extending bore, into which a valve body is seated. The valve body is moveable by an operator between an open position in which the housing inlet communicates with the tank outlet and a closed position in abutment with the annular surface. A seal ring which is captured along the periphery of the valve body can be moved into sealing engagement with the axially extending bore of the valve housing in the closed position for providing a water tight seal between the tank outlet and the housing inlet.

This construction provides a low actuating force for flushing the toilet, which does not vary excessively with the time between successive flushes. This construction also provides a positive stop for the flush valve in the closed position and can form a secondary seal between the valve body and the annular surface of the valve housing for further assurance against leakage.

In a preferred form of the invention, the seal ring has a dumbbell shaped cross-section having a radially outward bulbous portion and a radially inward bulbous portion integrally joined by an annular web portion. The valve body can be made in two pieces, with a retaining ring cooperating with the main body to form a cavity in the valve body which generally conforms to the shape of the seal ring. This captures the seal ring against being "blown off" the valve body by the force of water exiting the tank.

In another aspect of the invention, the reservoir tank inlet can have a tubular member which extends from an upper portion of the reservoir tank to a lower portion of the tank. The tubular member has a water discharge outlet opening in the lower portion of the tank. This reduces the amount of noise caused by refilling the tank after a flush. In an alternate embodiment, the tubular member has a breather hole above the full water level of the tank, which provides a path for air to relieve a vacuum in the tank which can be caused by draining the tank.

In another aspect of the invention, a special type of a backflow preventer upstream of the tank inlet is preferred. This type of backflow preventer has an inlet valve, an outlet valve and an atmospheric vent between the inlet and outlet valves. A positive pressure differential across the backflow preventer opens the valves and closes the vent to allow the flow of water through the backflow preventer toward the tank. A negative pressure differential across the backflow preventer closes the valves and opens the vent. This provides backflow protection against contaminating the potable water supply so that the tank outlet can be located below the toilet bowl rim, to allow a low profile design. This type of backflow prevention also helps enable extending the tank inlet into the lower portion of the tank to reduce noise upon refilling the tank.

DESCRIPTION OF THE DRAWINGS

FIG. 9 is a cross-sectional view of the flush valve assembly shown in FIG. 8;

FIG. 10 is a detail view of a portion of the flush valve assembly;

FIG. 11 is a cross-sectional view of an alternate inlet tube for the toilet; and FIG. 12 is a cross-sectional schematic view of a backflow preventer for a toilet of the invention.

DETAILED DESCRIPTION OF THE PREFERRED EMBODIMENT

Figure 1:
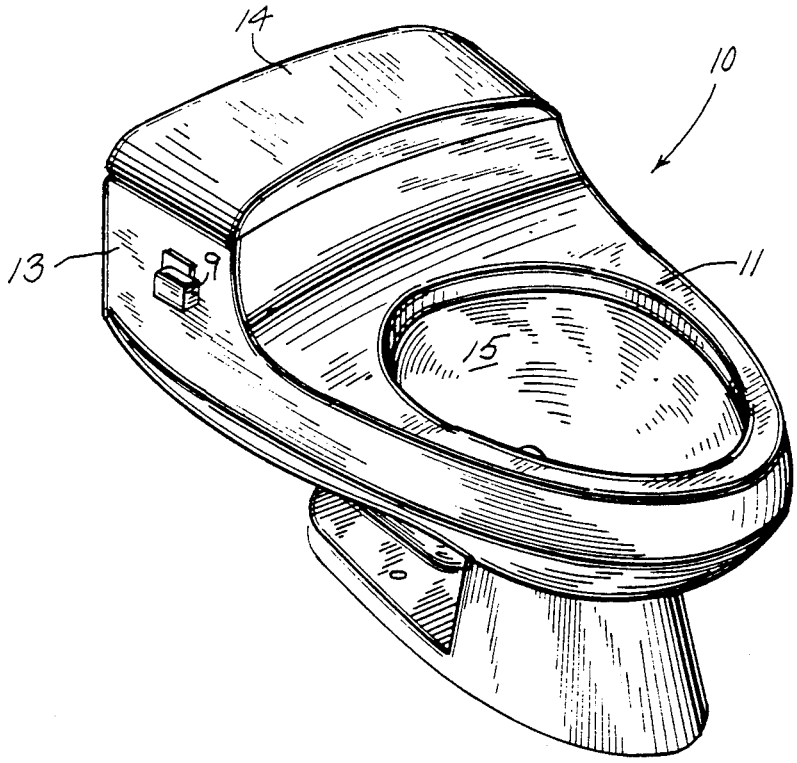
FIG. 1 is a perspective view of a toilet in which a preferred embodiment of the invention is mounted.

FIG. 1 depicts a toilet 10 having a pressurized flush tank system of the invention. The toilet shown is of a low profile design, in which a vitreous tank 13 comes only minimally higher than a toilet bowl rim 11. A cover 14 which allows assembly and removal of the contents of tank 13 rests on top of the tank 13. A handle 9 is provided on the side of the tank 13 for flushing the toilet.

Figure 2:
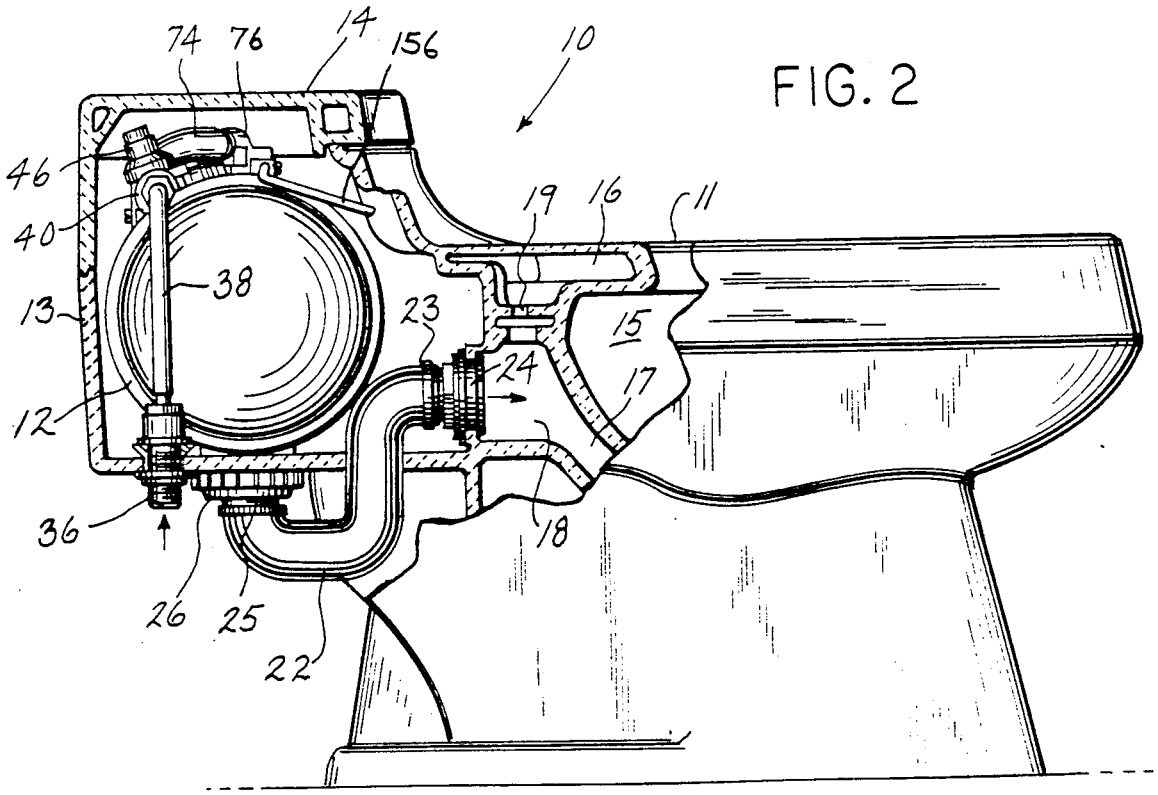
FIG. 2 is a side elevation view of the toilet of FIG. 1 with the rear portion broken away and without tubes 42, 48 and 68 for clarity.

FIG. 2 shows a pressurizable reservoir tank 12 inside the vitreous tank 13 of the toilet 10. The toilet 10 also has a toilet bowl 15 which has various flow channels cast into it. A rim distribution channel 16 surrounds the top portion of the bowl and distributes water around the top portion of the bowl to wash the sides of the bowl. A jet flow channel 17 leads to a jet (not shown) which is cast into the sump of the bowl 15 in conventional fashion to direct a fast moving stream of water in the bowl directly toward the toilet trap.

Both the rim chamber 16 and jet channel 17 emanate from a box distribution cavity 18 into which water under pressure from the reservoir tank 12 is expelled. A controlled diameter orifice 19 connects the rim channel 16 to the box distribution channel 18 so as to limit the flow to the rim and maintain adequate pressure to the jet channel 17. In the preferred embodiment, the orifice 19 is chosen so as to deliver a majority of the flush water to the jet channel 17.

Figure 3:
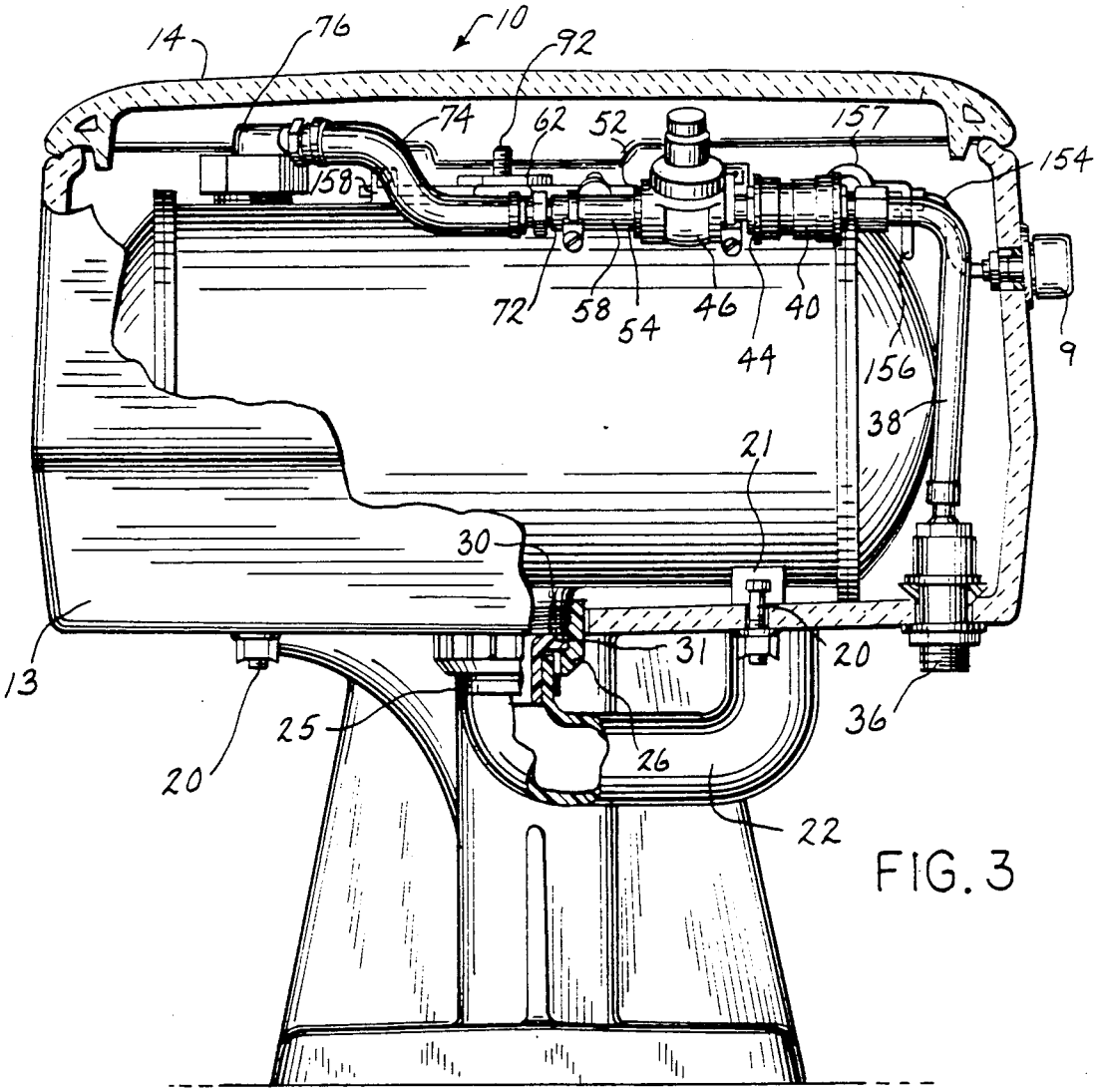
FIG. 3 is a rear elevation view of the toilet with the rear wall broken away and without tubes 42, 48 and 68 for clarity.

A hose 22, which may be made of rubber or other suitable material, is held by a clamp 23 to a fitting 24 which forms a water tight connection between the hose 22 and box 18 in a well-known manner. As shown in FIG. 3, the opposite end of the hose 22 is secured by a clamp 25 to a fitting 26 which is screwed onto the outlet 30 of the tank 12 to form a water tight connection between the hose 22 and the tank 12. An O-ring 31 may be provided between the fitting 26 and the outlet 30 to insure the watertightness of the connection.

The hose 22 is preferably made of a flexible material to allow for ease of assembly and to also enable more complete draining of the hose 22 and tank 12, for example, in winterization of the toilet. After the inlet water to the tank is turned off and the toilet is flushed, the fitting 26 can be easily disconnected from the tank 12 and the contents of the hose 22 and tank 12 drained into a bucket or other receptacle (not shown) to drain substantially all of the water from the tank.

The tank 12 receives water under pressure from a source of pressurized potable water, such as a city water supply. The volume of the tank in the preferred embodiment is approximately 2 gallons, and when fully charged, it holds approximately 1.5 gallons of water at a pressure of 25 psi. As such the tank must be made suitably strong to satisfy pressure vessel standards, and may preferably be made of a nylon plastic alloy. The tank 12 is secured to the vitreous tank 13 by bolts 20 whose heads are trapped in feet 21 which are molded into the tank 12.

The city or other pressurized water supply is connected to fitting 36 at the bottom of the vitreous tank 13. The fitting 36 communicates via conduit 38 with the inlet end of a backflow preventer 40.

The backflow preventer 40 prevents reverse flow of water should a negative pressure differential become established across the backflow preventer. Such backflow preventers are well-known and made according to industry standards. The backflow preventer 40 schematically shown in FIG. 12 has an inlet valve 32, an outlet valve 33, and an atmospheric vent 34 between the valves 32 and 33. Under normal flow conditions into the tank 12, the pressure of the incoming water opens the valves 32 and 33 to allow water to pass by them. At the same time, the valve 32 seals against valve seat 35 to prevent water from reaching the vent 34. If a negative pressure differential should develop across the backflow preventer 40, both valves return to the positions shown in FIG. 12 under the bias of springs 37 and 39. In those positions, valve 33 seals against seat 41 to prevent reverse flow and the area between the valves 32 and 33 is opened to the atmospheric vent 34, to further insure against reverse flow.

This type of backflow preventer is particularly important in the low profile toilet of the invention, since the outlet 30 is below the level of the toilet rim channel 16. In the preferred embodiment, a backflow preventer of the type described and which is approved under American Society of Sanitary Engineers Standard 1012 or an equivalent should be used. The particular backflow preventer found satisfactory in the preferred embodiment is sold under the commercial designation SA-9K by Watts Regulator Company, Lawrence, Mass.

Figure 4:
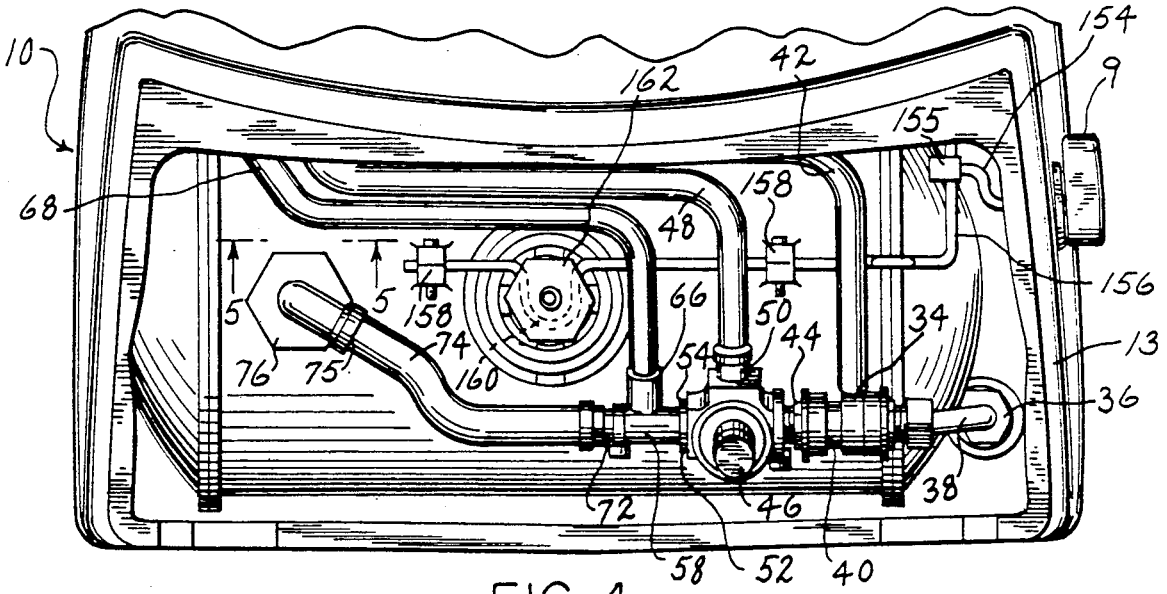
FIG. 4 is a top plan view of the toilet tank with the tank cover removed.

As shown in FIG. 4, tube 42 connects the vent 34 of the backflow preventer 40 to a vented cavity 43 (FIGS. 4, 5 and 6) which is above and in communication with rim channel 16. Should a negative pressure differential (the pressure at the inlet being lower than the pressure at the outlet) develop across the backflow preventer 40, water can be discharged through the tube 42 into the cavity 43, or atmospheric pressure from cavity 43 may be introduced through tube 42 to the vent 34, as needed.

Outlet end 44 of the backflow preventer 40 is connected to an inlet end 45 of a pressure regulator 46. The pressure regulator 46 is selected to maintain a certain pressure inside the reservoir tank 12, which is normally less than the pressure of the water upstream of the regulator 46 unless the water pressure on the upstream side of the regulator is less than the pressure limit to be maintained by the regulator. In the preferred embodiment, the pressure regulator is selected to maintain a pressure of 25 psi in the tank 12. The regulator 46 also preferably includes a pressure relief valve which spouts off pressure in the reservoir tank 12 should the pressure exceed a desired level, which is 50 psi in the preferred embodiment. Should that occur a tube 48 is connected to the discharge 50 of the pressure regulator 46. The tube 48 leads to the space 43 of the toilet (FIG. 6) so that an excessive pressure in the tank 12 can be discharged to the toilet without adverse consequences.

Figure 7:
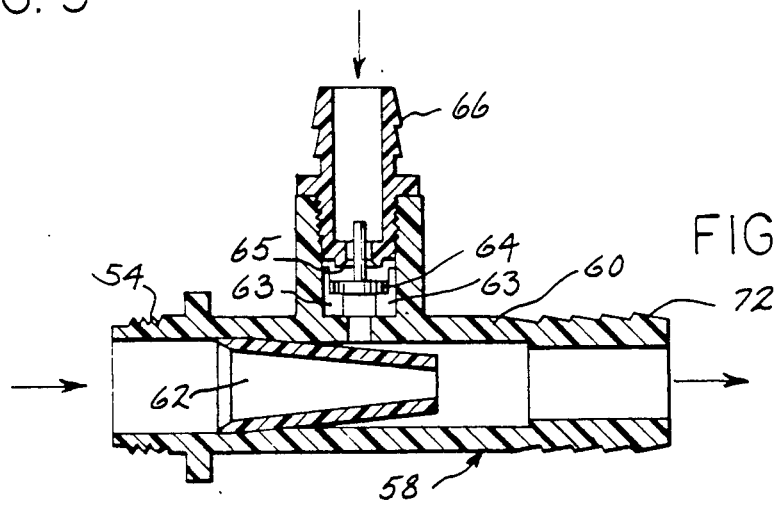
FIG. 7 is a cross-sectional view of an aspirator for the toilet.

Outlet 52 of the pressure regulator 46 is connected to inlet 54 of an aspirator 58, which is best shown in FIG. 7. The aspirator 58 includes a body 60 into which is pressed a nozzle 62. Water flows through the tapering inside bore of the nozzle 62 and creates a vacuum at its discharge from the nozzle 62 in the nature of a venturi. This vacuum sucks air into the aspirator past elastomeric disc valve 64 (shown in the open position resting on spaced apart guides 63) and into the water stream flowing into the reservoir tank 12 so as to provide an air space at the top of the tank 12 when the tank 12 is fully charged.

Figure 5:
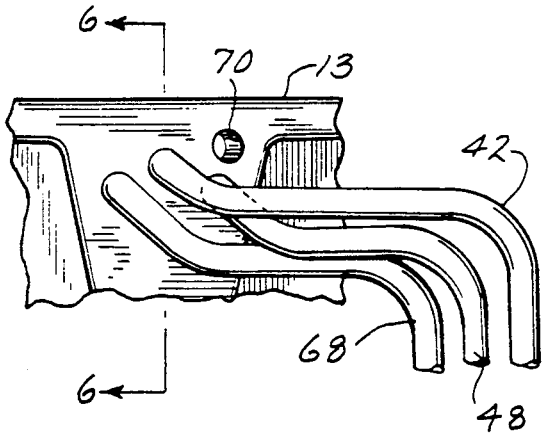
FIG. 5 is an elevation view of a portion of the toilet taken from the plane of the line 5—5 of FIG. 4.
Figure 6:
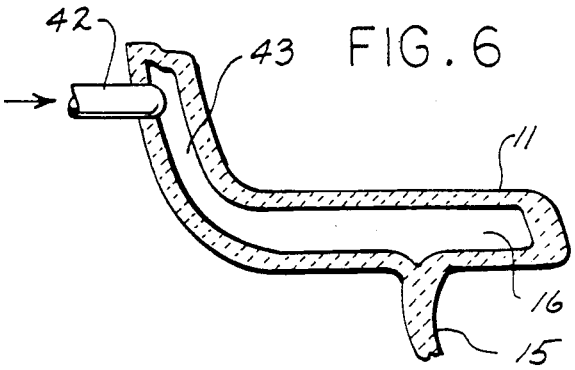
FIG. 6 is a cross-sectional view taken from the plane of the line 6—6 of FIG. 5.

When the pressure in tank 12 builds sufficiently, it acts upon the disc valve 64 to lift it off guides 63 and seat it against seat 65 of air inlet nipple 66. Hose 68 (FIGS. 4 and 5) connects the nipple 66 to the space 43 of the toilet 10. In FIG. 5, it can be seen that an extra hole 70 is provided into the space 43 so as to vent the space 43 and allow air to be drawn therefrom by tube 68 during aspiration by the aspirator 58 or by tube 42 from the backflow preventer as needed. The ends of the tubes 42, 48 and 68 and the hole 70 all open into the air space 43 and are in communication with the distribution channel 16 above the spill level of the toilet, which is at the level of rim 11, to insure against contaminated water ever reaching the tubes 42, 48 and 68 or hole 70 by backflow from the rim or toilet bowl.

Figure 8:
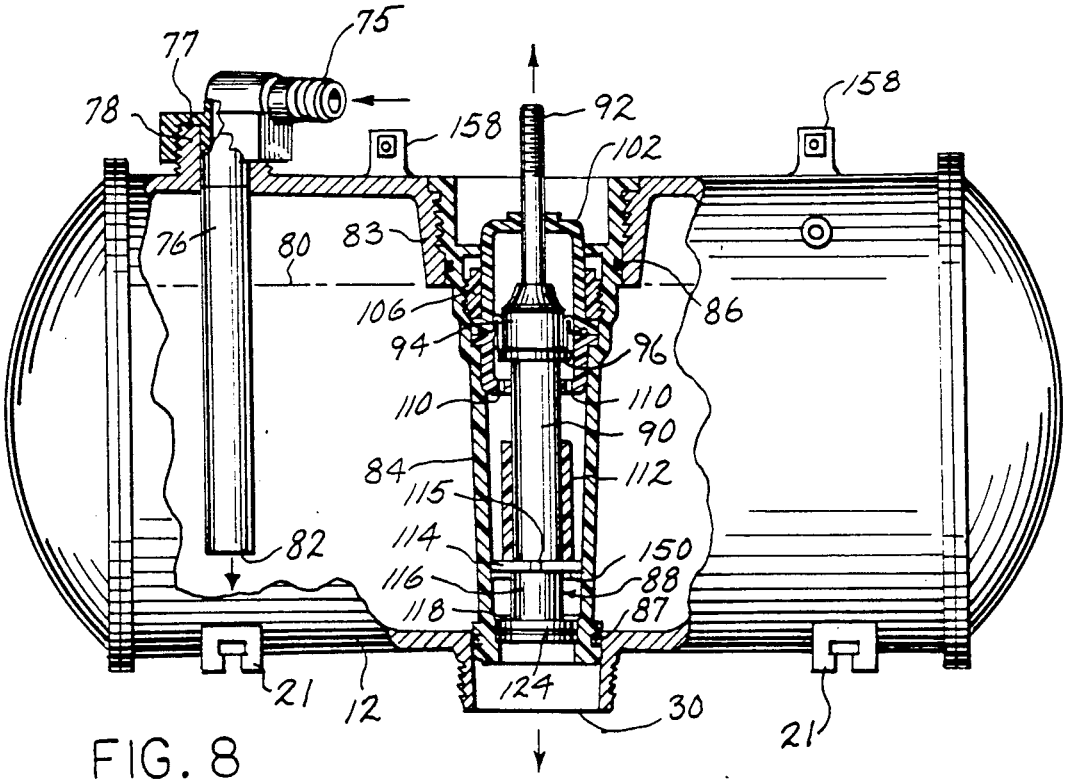
FIG. 8 is view of the reservoir, inlet tube and flush valve assembly for the toilet with portions broken away.

The aspirator 58 has an outlet 72 which is connected by hose 74 to inlet tube 76. Referring to FIG. 8, inlet tube 76 has a nipple 75 to which the hose 74 is connected and is screwed onto a top inlet flange 78 of the tank 12. An O-ring 77 forms an air-tight seal between the inlet tube 76 and the flange 78. The tube 76 extends downwardly into the lower portion of the tank 12.

Referring to FIG. 8, line 80 indicates the approximate water level in the tank 12 when the tank 12 is fully charged to the preset pressure determined by the pressure regulator. As can be seen, the lower end 82 of the inlet tube 76 is considerably below the line 80. The tube 76 extends near to the bottom of the tank 12 so as to reduce the noise of incoming water upon refilling the tank 12. As stated above, when the pressure in the tank 12 reaches the preset pressure, the pressure regulator 46 stops the flow of incoming water. It should also be noted that the inlet tube 76 extends below the level of the toilet rim channel 16, which increases the importance of using the type of backflow preventer described herein.

Still referring to FIG. 8, the top central portion of the tank 12 has an internally threaded flange 83 which extends down into the tank 12. Referring also to FIG. 9, a valve housing 84 is threaded down into the flange 83 and forms an air-tight seal therewith via O-ring 86. The valve housing 84 extends downwardly into the tank outlet and forms a watertight seal against the tank outlet via O-ring 87.

In addition to the valve housing 84, the flush valve assembly includes a valve body 88, a valve stem 90, and a valve operator 92. The valve stem 90 is screwed at its lower end into the valve body 88 and its upper end into the operator 92. At the upper end of the valve stem 90, the valve operator 92 sandwiches a diaphragm 94 against a flange 96 which is backed up against a shoulder 98 of the valve stem 90. The diaphragm 94 has a bead 100 at its outer periphery captured between an upper guide 102 and a lower guide 104. The diaphragm bead 100 seals the unpressurized space above it from the pressurized space below it. An O-ring 105 forms a seal between the guide 104 and the valve housing 84.

The upper and lower guides 102 and 104 are secured inside the valve housing 84 by a lock screw 106 having lugs 108 for turning the screw 106. The upper and lower guides 102 and 104 have bores through them through which the operator 92 and valve stem 90, respectively, can slide up and down. The lower guide 104 also has breather holes 110 in its lower end to equalize the pressure above and below the lower guide 104.

A stop sleeve 112 surrounds the valve stem 90 and abuts the valve body 88 at its lower end. When the operator 92 is lifted, the stop sleeve 112 moves upwardly with the valve body 88 and valve stem 90 until the top of the stop sleeve 112 abuts the lower guide 104, which stops the upward movement of the valve body 88.

The valve body 88 has an upper flange 114 which centers the valve body 88 in the valve housing 84 and has grooves 115 provided around its periphery to allow the equalization of pressure above and below the flange 114. A shank portion 116 connects the upper flange 114 to a lower flange 118. In the closed position shown in FIG. 9, the lower flange 118 is in registration with an axially extending bore 120 of the valve housing. Referring to FIG. 10, the lower flange 118 fits inside the bore 120 with a sliding fit. An elastomeric seal ring 124 is captured inside the lower flange 118 of the valve body 88 and is in sealing engagement with the axially extending bore 120 in the closed position shown in FIGS. 9 and 10.

As the valve body 88 is lowered into the closed position, the radially outward circumferential periphery of the ring 124 slides along conical surface 126 of the valve housing 84 and is compressed into sealing contact with the bore 120. In addition to the bore 120, the valve seat of housing 84 includes an annular surface 130. When the bottom of the valve body 88 reaches annular surface 130 (See FIG. 10), the downward movement of the valve body 88 is positively stopped. In this position, the seal ring 124 forms a fluid tight seal against the bore 120. Moreover, a secondary seal is formed between the annular surface 130 and the periphery of the bottom of the valve body 88 to further insure against leakage from the tank 12.

Still referring to FIG. 10, the seal 124 has an outer bead 140 and an inner bead 142. The outer and inner beads 140 and 142 are integrally joined by a web section 144. Although the outer bead 140 is somewhat larger than the inner bead 142, this cross-sectional shape is generally referred to as "dumbbell" shaped in that it has a radially outward bulbous portion and a radially inward bulbous portion joined by an annular web portion.

A retaining ring 146 is ultrasonically welded to main body 148 of valve body 88 to capture the seal ring 124 inside the valve body 88. Together, the retaining ring 146 and main body 148 define a cavity in the valve body 88 which generally conforms to the seal ring 124. Although ultrasonic welding is preferred to secure the retaining ring 146 to the main body 148, other suitable means could also be employed. This construction prevents the seal ring 24 from being "blown off" the valve body 88 from the force of the water exiting the tank 12.

The valve body 88 is capable of forming a secondary seal with the valve housing 84 at the annular surface 130 because it is made of a reasonably pliant plastic material. The preferred material for the valve body 88 is acetal plastic and the material of the valve housing 84 used in the preferred embodiment is a 65% mineral filled polyphenylene sulfide plastic material.

All of the other parts of the valve assembly are also made of plastic materials, except for the elastomeric diaphragm 94 and sealing rings, and except for the valve stem 90. The valve stem 90 in the preferred embodiment is made of stainless steel so that it has sufficient weight to return the valve body 88 to the closed position after a flushing operation.

When the valve 88 is lifted off the annular surface 130 by operator 92 so as to disengage the seal ring 124 from the bore 120, the pressurized contents of the tank 112 are released through inlets 150 in the side of valve housing 84 to the interior of the valve housing 84 and then down past the valve body 88 out through the outlet 30 of the tank 12. From there the pressurized tank contents flow through the hose 22 to the toilet bowl as previously described. The pressure of the water flowing beneath the valve body 88 maintains the valve body in an open, elevated position out of sealing engagement with the bore 120 until the pressure in the tank 112 subsides sufficiently to allow the valve body 88 to return by gravity to its closed position against annular surface 130.

This construction provides a relatively low force requirement to flush the toilet. The area of the bore 120 is somewhat larger than the effective cross-sectional area of the diaphragm 94 (the area of a circle having a diameter equal to the diameter of the centerline of the roll of the diaphragm), so as to provide a slight bias toward the closed position of the flush valve. This bias, combined with the weight of the flush valve and the friction of the components, results in a relatively low average force to move the valve from the closed to the open position. Moreover, it has been found that even after long periods of remaining in the closed position, the force does not increase excessively.

These relatively low forces allow the operator 92 to be actuated in a conventional fashion. In the preferred embodiment, a handle 9 is provided along the side of the toilet tank as shown in FIGS. 1, 3 and 4 as described above. An arm 154 extends from the handle 9 into the interior of the tank 13 which rotates with the handle 9 when the handle 9 is operated by a toilet user in the usual way. A bearing 155 of wear resistant plastic material cams on a lever arm 156 of trip rod 157. The trip rod 157 is journaled in bearing blocks 158 on the tank 12. The trip rod 157 is journaled eccentrically of the operator 92 and has a portion 160 which is bent around the operator 92 and beneath a nut 162 which is screwed onto the operator 92 (See FIGS. 3 and 4). When the lever arm 156 is rotated downwardly by operating the handle 9, the portion 160 of trip arm 157 lifts nut 162 and thereby operator 92 upwardly to break the seal between valve body 88 and the valve housing 84 thereby effecting a flush.

An alternate embodiment 76' of the inlet tube 76 is shown in FIG. 11. The inlet tube 76' is identical to the inlet tube 76 except that inlet tube 76' includes a breather hole 170 at a level above the full water line 80 of the tank 12. Although the breather hole 170 may be provided at any level along the depending length of the inlet tube 76' above the full water level 80 of the tank 12, it is shown and preferred to be provided adjacent to the inlet flange 78 of the tank 12. In this area the breather hole 170 is less accessible to water inside the tank but still can provide for the flow of air through it to and from the tank.

The breather hole 170 is provided so that when the inlet water to the tank 12 is turned off by an upstream valve (not shown), the tank 12 can be drained, such as during winterization of the toilet. After turning off of the water, the toilet could be flushed thereby lifting the valve body 88 to its open position to drain the tank 12. When the water level in the tank 12 has lowered to a sufficient extent, a vacuum is created in the tank 12. This vacuum would be communicated via breath hole 170 to aspirator valve 158 which would move valve disc 164 away from seat 65 and admit atmospheric pressure through hole 170 to tank 112 to relieve the vacuum. This would allow for draining of tank 12.

We claim:

1. A pressurized flush toilet system, comprising:

a toilet having a toilet bowl and a rim around the upper periphery of the toilet bowl;

a reservoir tank for containing a pressurized volume of flush water for said toilet, said reservoir tank having an inlet and an outlet, said outlet being below the toilet bowl rim and connected to the toilet to deliver water to the toilet bowl;

a flush valve operable by a toilet user for selectively providing communication between the reservoir tank and the toilet bowl; and a backflow preventer upstream of the tank inlet having an inlet valve, an outlet valve and an atmospheric vent between said inlet and outlet valves, wherein a positive pressure differential across the backflow preventer opens the valves and closes the vent to allow the flow of water through the backflow preventer toward the tank and a negative pressure differential across the backflow preventer closes the valves and opens the vent to prevent reverse flow through the backflow preventer away from the tank;

wherein the toilet bowl rim has a rim distribution channel in its interior and further comprising a conduit for providing communication between the vent of the backflow preventer and the rim distribution channel above the spill level of the toilet bowl.

2. A system as in claim 1, wherein said conduit opens into an air space inside the toilet which is in communication with said rim distribution channel and has a vent to atmospheric pressure, said vent being above the spill level of the toilet.

3. A system as in claim 2, further comprising a pressure relief valve and an aspirator upstream of the tank inlet, said pressure relief valve having a discharge which is in communication with said air space and said aspirator having an air inlet which is in communication with said air space above the spill level of the toilet.

* * * * *